United States Patent [19]

Alcock et al.

[11] Patent Number: 4,827,752

[45] Date of Patent: May 9, 1989

[54] WIRE DRAWING MACHINE WITH WIRE-RELAXING ROLLER

[75] Inventors: Richard A. Alcock, Roscoe; Robert M. Guthrie, Rockford, both of Ill.

[73] Assignee: Rockford Manufacturing Group, Inc., Roscoe, Ill.

[21] Appl. No.: 203,064

[22] Filed: Jun. 6, 1988

[51] Int. Cl.[4] ..... B21C 1/14

[52] U.S. Cl. ..... 72/289; 242/157.1; 242/156.1

[58] Field of Search ..... 72/289, 280, 423; 242/157.1, 156.1, 157 R, 78; 57/352

[56] References Cited

U.S. PATENT DOCUMENTS

| | | | |
|---|---|---|---|
| 1,167,239 | 1/1916 | Winkler | 242/157.1 |
| 2,279,133 | 4/1942 | Cross | 242/157.1 |
| 3,836,123 | 9/1974 | Bausenbach et al. | 242/157.1 |
| 4,099,403 | 7/1978 | Alcock et al. | 72/289 |

FOREIGN PATENT DOCUMENTS

| | | | |
|---|---|---|---|
| 709934 | 8/1941 | Fed. Rep. of Germany | 242/157.1 |
| 860530 | 1/1941 | France | 242/157 R |
| 1026881 | 7/1983 | U.S.S.R. | 72/289 |

*Primary Examiner*—Daniel C. Crane
*Attorney, Agent, or Firm*—Leydig, Voit & Mayer

[57] ABSTRACT

An in-line wire drawing machine in which a roller with a one-way clutch allows wire to unwind from a rotatable drum while preventing the wire from slipping reversely on the drum. The roller is supported to float axially relative to the drum so as to track the natural course of the final wrap of wire and is spring-urged against the wire in all of its axial positions.

1 Claim, 1 Drawing Sheet

WIRE DRAWING MACHINE WITH WIRE-RELAXING ROLLER

BACKGROUND OF THE INVENTION

This invention relates to an in-line wire drawing machine of the type which pulls a length of wire through a drawing die and supplies the wire to a using station where a production machine such as a cold header performs an operation on the wire. More particularly, the invention relates to a wire drawing machine of the same general type as disclosed in Alcock et al U.S. Pat. No. 4,099,403.

In such a wire drawing machine, a helical coil of wire is wrapped around a rotatable drum. When the drum is rotated, wire is drawn through the die and wound onto one end of the drum and, at the same time, wire is unwrapped from the other end of the drum and is delivered to the production machine. It is desirable to obtain maximum traction between the wire and the drum in order to develop sufficient force to pull the wire through the drawing die and to prevent the wire from slipping on and galling the drum. Also, it is desirable that the wire leave the drum with minimum tension so that the wire will not pull back on the production machine. In the wire drawing machine of the above-identified Alcock et al patent, these ends are achieved through the provision of a wire-relaxing roller which holds the final wrap of wire against the drum and which prevents the wire from slipping on the drum so as to increase the traction between the wire and the drum. A one-way clutch permits the roller to rotate in a direction allowing wire to be removed from the drum but prevents the roller from rotating in the opposite direction and thereby prevents slippage of the wire on the drum.

The final wrap of wire tends to expand axially from the helix defined by the main coil of wire. Under different conditions or with different types or sizes of wire, the final wrap may tend to take different axial positions along the drum. The axially fixed roller of the wire drawing machine of the Alcock et al patent holds the final wrap in a fixed axial position and, as a result, may exert side loads causing undesirable scraping and marking of the wire.

SUMMARY OF THE INVENTION

The general aim of the present invention is to provide a new and improved wire drawing machine in which the roller, while being constantly biased against the final wrap of wire, is free to float axially of the drum so as to track the natural course of the final wrap and avoid the imposition of significant side loads on the wire.

A more detailed object of the invention is to achieve the foregoing through a unique roller mounting which pivots the roller toward and presses the roller against the final wrap of wire while enabling the roller to float axially of the drum to positions determined by th path which the final wrap tends to follow as it unwinds from the drum.

These and other objects and advantages of the invention will become more apparent from the following detailed description when taken in conjunction with the accompanying drawings.

DETAILED DESCRIPTION OF THE PREFERRED EMBODIMENT

Figure 1:
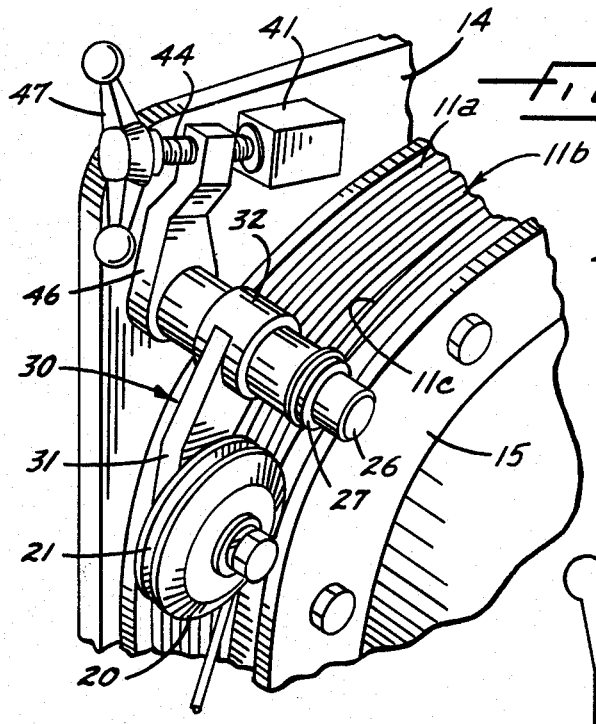
FIG. 1 is a fragmentary perspective view of a new and improved wire drawing machine incorporating the unique features of the present invention.

As shown in the drawings for purposes of illustration, the invention is embodied in a machine 10 for pulling a length of wire through a drawing die (not shown) which serves to reduce the diameter of the wire. The drawing die is secured to the main support or frame of the machine, the frame being indicated generally by the reference numeral 14.

To pull the wire through the die, the machine 10 includes a capstan or drum 15 adapted to be rotated about a horizontal axis, the drum being supported on the frame 14. When the drum 15 is rotated, an entering length of wire 11*a* is pulled onto one end portion of the drum (hereinafter called the entrance end portion) and the wire is wound in a helical coil 11*b* around the drum, the coil being composed of a number of wraps in a single layer. At the other end portion of the drum (hereinafter called the exit end portion), an exiting length of wire 11*c* is uncoiled from the drum and is supplied to apparatus such as a further drawing die, a wire straightener, a wire winding machine, a cold header or other production machine.

The drum 15 is rotated by a variable speed mechanical drive mechanism of the type disclosed in Alcock et al U.S. Pat. No. 4,099,403. Reference is made to that patent for a detailed disclosure of the drive mechanism and of means for controlling the speed of rotation of the drum.

Provision is made of means for preventing the wire from slipping on the drum 15. Herein, these means comprises a roller 20 which holds the final wrap 11*c* of wire against the exit end portion of the drum and prevents the wire from slipping backwards along the drum. The periphery of the roller is formed with a circumferentially extending and substantially V-shaped groove 21 which receives the final wrap 11*c* of the wire coil 11*b*. The roller is connected to the output member of a one-way clutch 25 such as a conventional sprag clutch. The clutch permits the roller to rotate in a direction opposite to the direction of rotation of the drum 15 but prevents the roller from rotating in the same direction as the drum. Accordingly, the roller may rotate to allow the wire to unwind from the drum but, if the wire tends to slip backwards, the clutch holds the roller against rotation and thus the roller pinches the final wrap of wire against the drum. With the final wrap 11*c* being held by the roller, the wire coil 11*b* tends to wrap down tightly on the drum in a manner similar to a spring clutch. The wire thus is prevented from slipping and, as a result, maximum traction between the wire and the drum is obtained. In addition, minimum tension is imposed on the wire as the wire is drawn from the drum.

In accordance with the present invention, the roller 20 is supported in such a manner as to enable the roller to float axially of the drum 15 and freely track the course of the final wrap 11*c* of wire as the wire is unwound form the drum. Such floating significantly reduces side loading of the wire by the roller and virtually eliminates scraping and marking of the wire. Despite being capable of floating axially, the roller is constantly spring-biased against the drum so as to exert radial pressure against the wire in all axial positions of the roller.

Figure 3:
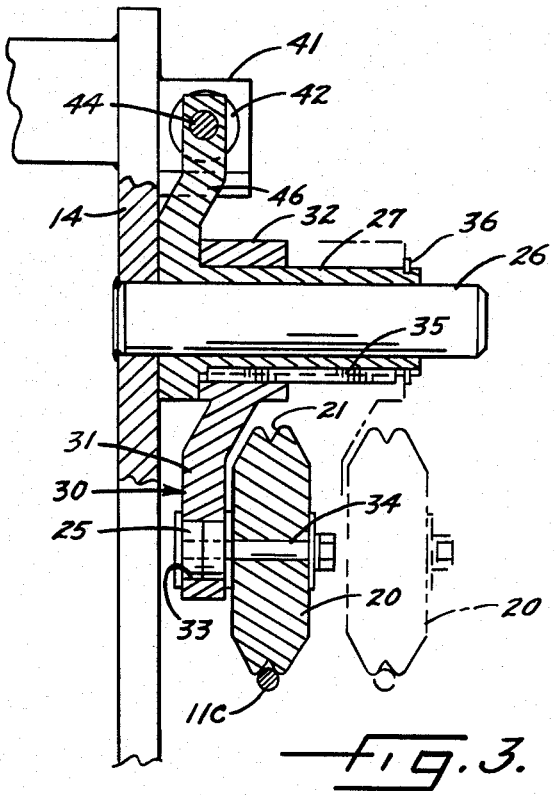
FIG. 3 is a fragmentary cross-section taken substantially along the line 3—3 of FIG. 2.

More specifically, the roller 20 is supported from an elongated cylindrical rod 26 welded to the frame 14 and extending parallel to the rotational axis of the drum 15. Rotatably supported on the rod is a cylindrical sleeve 27 (FIG. 3) which is capable of turning freely on the rod.

Figure 2:
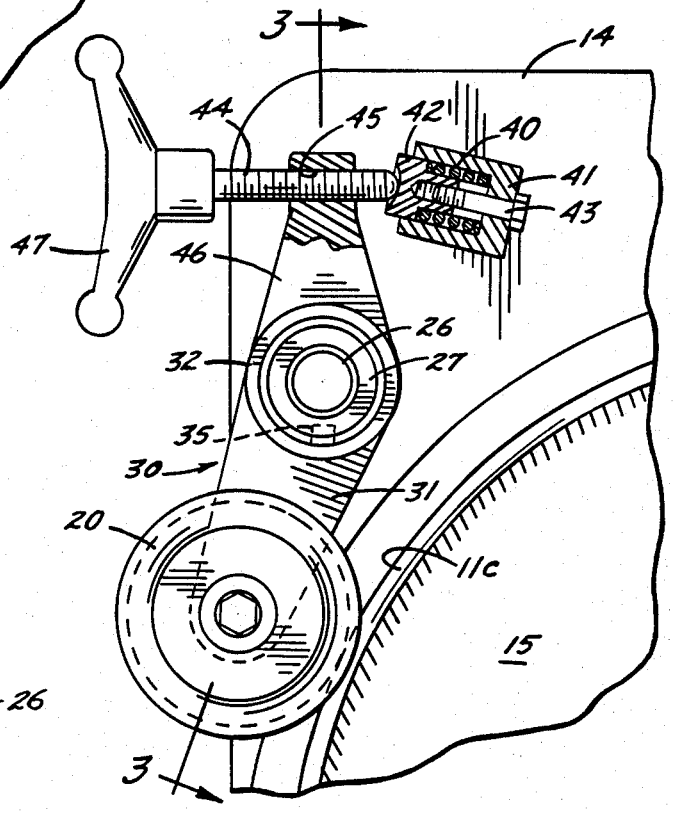
FIG. 2 is an enlarged fragmentary side elevational view of the machine shown in FIG. 1, certain parts being broken away and shown in section.

The roller 20 is associated with a bracket 30 having an elongated and generally vertical depending arm 31 and having a cylindrical sleeve 32 formed integrally with the upper end portion of the arm. The clutch 25 is housed within a bore 33 (FIG. 3) in the lower end of the arm and is connected to a shaft 34 which is coupled securely to the roller 20 so as to cause the roller and the shaft to rotate as a unit. The clutch permits the roller to rotate in a counterclockwise direction (FIG. 2) but prevents clockwise rotation of the roller.

Pursuant to the invention, the sleeve 32 of the bracket 30 is supported to slide freely along the sleeve 27 but is prevented from rotating relative to the sleeve 27. For this purpose, the sleeve 32 is telescoped slidably over the sleeve 27 and is held against rotation relative thereto by an elongated key 35 (FIG. 3) located between the two sleeves. The sleeve 32 is substantially shorter than the sleeve 27 and is prevented from sliding off of the sleeve 27 by a snap ring 36 on the latter sleeve.

To bias the roller 20 toward the drum 15, a coiled compression spring 40 (FIG. 2) is contained within a housing 41 on the frame 14 and acts against a plunger 42, a screw 43 being threadably connected to the plunger and permitting the plunger to slide in and out of the housing while limiting the extent of outward sliding. Bearing against the outer end of the plunger is an adjusting screw 44 which is threaded in a hole 45 in an arm 46 formed integrally with and projecting upwardly from the sleeve 27. A hand wheel 47 is fastened to the outer end of the screw 44 to facilitate adjustment of the screw relative to the arm 46.

With the foregoing arrangement, the roller 20 is free to float axially of the drum 15 as a result of the sleeve 32 being slidable on the sleeve 27. Thus, the roller is capable of axially tracking the final wrap 11c of wire and allows the final wrap to seek its own course so as to avoid the imposition of side loads on the wire. Regardless of its axial position, the roller is continuously urged against the wire as a result of the spring-loaded plunger 42 acting through the screw 44 and the arm 46 to bias the sleeve 27 counterclockwise (FIG. 2) about the shaft 26. Because of the key 35, the sleeve 32 turns with the sleeve 27 and thus the spring 40 is effective to bias the roller counterclockwise against the wire. By adjusting the screw 44 with the hand wheel 47, the initial angular position of the roller relative to the axis of the shaft 26 may be changed and, by adjusting the screw 43, the spring force exerted on the roller may be changed.

We claim:

1. A wire drawing machine comprising a support, a drum mounted on said support to rotate in one direction about its own axis, said drum having an entrance end portion for receiving wire and having an exit portion from which the wire is supplied from the drum, there being a coil of wire wrapped around said drum between said entrance and exit end portions with said coil being composed of a number of wraps in a single layer, a roller engaging the final wrap of wire on the exit end portion of said drum, a one-way clutch connected to said roller and permitting said roller to rotate in a direction opposite to the direction of rotation of said drum while preventing said roller from rotating in the same direction as the drum whereby said roller prevents said wire from slipping on and uncoiling from said drum, the improvement in said wire drawing machine comprising, means for mounting said roller to axially track said final wrap of wire while biasing said roller against said final wrap, said means comprising a shaft connected to said support and extending parallel to the axis of said drum, a first sleeve supported rotatably and non-slidably on said shaft, a bracket supporting said roller and having a second sleeve, said second sleeve being telescoped slidably over said first sleeve and permitting said bracket to freely move axially of said drum thereby to enable said roller to axially track said final wrap of wire, means preventing said second sleeve from rotating relative to said first sleeve, and means for urging said first sleeve to turn about said shaft thereby to bias said roller against said final wrap of wire.

* * * * *